United States Patent [19]

Satou

[11] Patent Number: 4,693,227

[45] Date of Patent: Sep. 15, 1987

[54] MULTI-FUEL INJECTION SYSTEM FOR AN INTERNAL COMBUSTION ENGINE

[75] Inventor: Yasuo Satou, Susono, Japan

[73] Assignee: Toyota Jidosha Kabushiki Kaisha, Aichi, Japan

[21] Appl. No.: 860,584

[22] Filed: May 7, 1986

[30] Foreign Application Priority Data

| | | | |
|---|---|---|---|
| May 21, 1985 | [JP] | Japan | 60-106833 |
| Aug. 22, 1985 | [JP] | Japan | 60-182992 |
| Oct. 9, 1985 | [JP] | Japan | 60-223791 |
| Oct. 12, 1985 | [JP] | Japan | 60-155259[U] |
| Oct. 12, 1985 | [JP] | Japan | 60-155261[U] |
| Oct. 12, 1985 | [JP] | Japan | 60-155264[U] |

[51] Int. Cl.[4] ..... F02M 39/00

[52] U.S. Cl. ..... 123/575; 123/300; 417/382

[58] Field of Search ..... 123/299, 300, 575, 446, 123/449, 576, 577, 578; 417/380, 382; 239/473, 265.25, 265.27, 265.29, 265.81

[56] References Cited

U.S. PATENT DOCUMENTS

| | | | |
|---|---|---|---|
| 3,292,546 | 12/1966 | Evans | 417/382 |
| 3,450,053 | 6/1969 | McCulloch | 417/382 |
| 4,022,165 | 5/1977 | Eckert | 123/300 |
| 4,289,098 | 9/1981 | Norberg | 123/300 |
| 4,416,229 | 11/1983 | Wood | 123/300 |
| 4,481,921 | 11/1984 | Tsukahara et al. | 123/300 |
| 4,520,774 | 6/1985 | Sitter | 123/575 |
| 4,546,739 | 10/1985 | Nakajima | 123/299 |
| 4,590,903 | 5/1986 | Hofmann | 123/200 |
| 4,590,904 | 5/1986 | Wannenwetsch | 417/382 |
| 4,606,522 | 8/1986 | Reid | 123/575 |
| 4,612,905 | 9/1986 | Deitrich | 123/575 |

FOREIGN PATENT DOCUMENTS

| | | | |
|---|---|---|---|
| 851570 | 8/1952 | Fed. Rep. of Germany | 123/300 |
| 887430 | 8/1953 | Fed. Rep. of Germany | 417/382 |
| 2309916 | 10/1974 | Fed. Rep. of Germany | 123/300 |
| 0172454 | 10/1983 | Japan | 123/299 |
| 183459 | 10/1923 | United Kingdom | 417/382 |
| 2126650 | 3/1984 | United Kingdom | 123/300 |

*Primary Examiner*—Carl Stuart Miller

*Attorney, Agent, or Firm*—Parkhurst & Oliff

[57] ABSTRACT

A multi-fuel injection system for an internal combustion engine having first and second fuel injection pumps for delivering first and second fuels, respectively, wherein a fuel injection nozzle has two fuel inlet passages. The first pump has a plurality of fuel outlets for delivering the first fuel into respective fuel inlet passages of the nozzle, one by one. The second pump has a single outlet from which the second fuel is delivered simultaneously into second fuel inlet passages of all nozzles except that which is forced in operation by the first pump. The second fuel is thus filled several times during one cycle of the engine to establish an averaged charge between the cylinders.

22 Claims, 21 Drawing Figures

MULTI-FUEL INJECTION SYSTEM FOR AN INTERNAL COMBUSTION ENGINE

BACKGROUND OF THE INVENTION

1. Field of the Invention

The present invention relates to a multi-fuel injection system for an internal combustion engine having a plurality of cylinders. More particularly, the present invention relates to a fuel injection system for a diesel engine in which is used a main fuel such as an alcohol fuel having a poor self-ignitable property and an auxiliary fuel such as a diesel fuel having a good self-ignitable property.

2. Description of the Related Art

It is known in the art that, in the multi-fuel injection system, the alcohol fuel and the diesel fuel are preferably injected in a stratified manner without substantial mixing. To this end, a minor ignitable fuel is first injected to provide a kindling fuel, and then the main alcohol fuel is injected.

U.S. Pat. No. 4,416,229 discloses a fuel injection system for a diesel engine having a single injector for injecting diesel fuel and alcohol fuel into each combustion chamber of the engine in the form of a plume having diesel fuel at its tip, so that the diesel fuel is ignited by the compression in the chamber and the alcohol fuel is ignited by the ignition of the diesel fuel. The fuel injection nozzle has two fuel inlet passages formed therein to introduce the respective fuels, which fuels meet near the valve seat. The diesel fuel is delivered into the nozzle space under a pressure below the nozzle opening pressure, to replace the alcohol fuel therein and to fill the space at a timing between consecutive fuel injection timings at which the alcohol fuel is injected under a pressure sufficient to open the nozzle.

U.S. Pat. No. 4,481,921 and the corresponding Japanese Unexamined Patent Publication Nos. 58-206,859 and 58-206,867 disclose a fuel injection apparatus having fuel injection nozzles similar to those disclosed in the U.S. Pat. No. 4,416,229.

To compressively deliver the two kind of fuels under different pressures, it is necessary to provide two different fuel injection pumps. For this purpose, U.S. Pat. No. 4,416,229 has two fuel injection pumps having a plurality of fuel outlets, respectively. U.S. Pat. No. 4,481,921 has a fuel injection pump having a plurality of fuel outlets for alcohol fuel and a plurality of fuel compressors having respective fuel outlets for the diesel fuel. In both cases, fuel are delivered into the fuel injection nozzles through the specific fuel outlets having a fixed relationship relative to that nozzle. Therefore, the delivered diesel fuel, which may be fundamentally small in volume, may vary between the cylinders of the engine due to manufacturing errors in the individual elements.

Since the diesel fuel is to be delivered in small amounts under a relatively low pressure, it would be desirable to construct the fuel injection pump for the diesel fuel using a far simpler design. In this regard, the above-referenced U.S. Pat. No. 4,481,921 uses fuel compressors having a very simple design, which are driven by the pressure of the alcohol fuel injected by the main fuel injection pump. However, in this design each cylinder of the engine must be equipped individually with a compressor and thus the connections between the compressors, main fuel injection pumps, and nozzles are complicated.

SUMMARY OF THE INVENTION

It is an object of the present invention to provide a multi-fuel injection system for an internal combustion engine wherein two kind of fuels i.e., one having good self-ignitability and one having poor self-ignitability, can be injected in a stratified manner from a single fuel injection nozzle located on each of the cylinders of the engine so that the fuel having good self-ignitability is first injected from the tip of the nozzle. It is a further object of the present invention to provide a multi-fuel injection system for an internal combustion engine wherein such a fuel having a good self-ignitability can be uniformly distributed between the nozzles to thereby allow a reliable ignition of the other fuel.

According to the present invention, there is provided a multi-fuel injection system for an internal combustion engine having a plurality of cylinders, the system comprising: a first fuel injection pump having a plurality of fuel outlets for delivering a first fuel in a predetermined cycle under a pressure above a predetermined value; a second fuel injection pump having a single fuel outlet and adapted to be driven synchronously with the first fuel injection pump for delivering a second fuel under a pressure below that predetermined value; a plurality of fuel injection nozzles arranged in such a manner that one nozzle is equipped to each cylinder of the engine, each of the fuel injection nozzles comprising a body having a cavity therein, at least one fuel injection port for injecting fuel from the cavity to the respective cylinder, a valve seat about the fuel injection port, a valve member inserted in the body of the nozzle so as to engage with the valve seat and thus open or close the fuel injection port, first and second fuel inlet passages formed through the nozzle body for introducing the first and second fuels into the cavity, respectively, and means for causing the valve member to open the fuel injection port when the pressure of the introduced fuel is above the predetermined value and to close the port when the pressure is below the predetermined value; a first set of fuel pipes for interconnecting the outlets of the first fuel injection pump and the first inlet passages of the fuel injection nozzles one by one, respectively; a second set of fuel pipes having one end commonly connected to the single outlet of the second fuel injection pump and having the other end connected to the second fuel inlet passages of the fuel injection nozzles one by one; and means for preventing a backflow of the second fuel from each of the second inlet passages to the single outlet of the second fuel injection pump.

The other objects and features of the present invention will become apparent from the description below.

BRIEF DESCRIPTION OF THE DRAWINGS

The invention will be described below in detail with reference to the accompanying drawings, which show preferred embodiments of the present invention, and in which.

DESCRIPTION OF THE PREFERRED EMBODIMENTS

Figure 1:
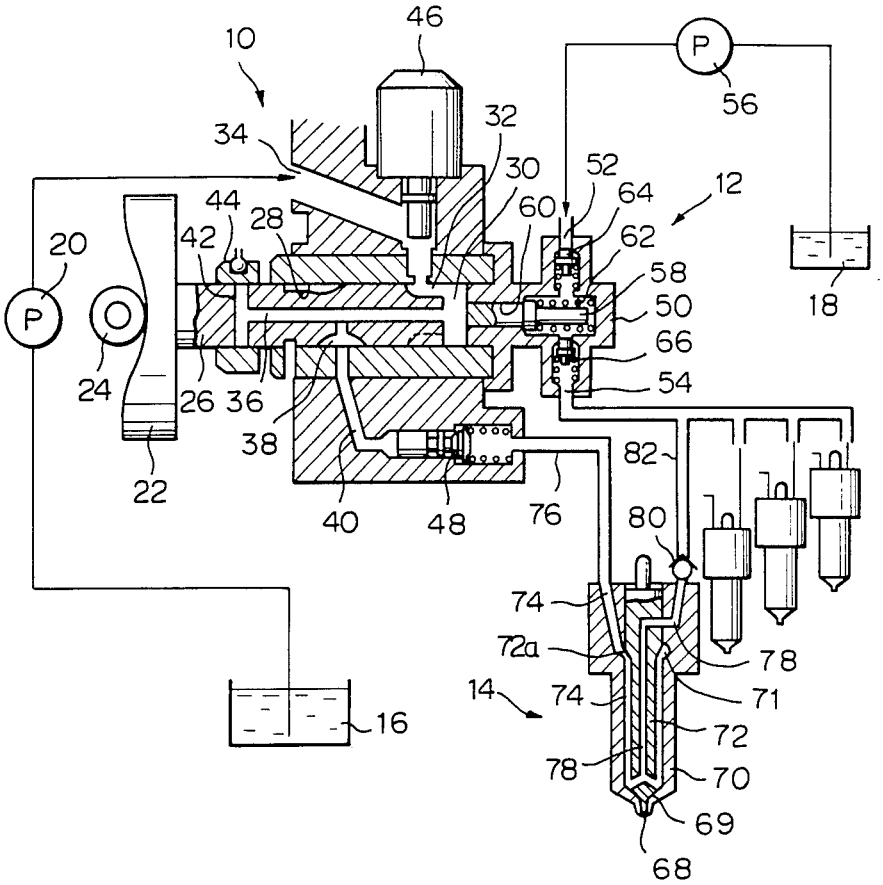
FIG. 1 is a diagrammatic view illustrating a multi-fuel injection system according to a first embodiment of the present invention.

FIG. 1 show a multi-fuel injection system for an internal combustion engine, according to the present invention, which comprises a first rotary-distributor type fuel injection pump 10, a second fuel injection pump 12, and a plurality of fuel injection nozzles 14 arranged one by one for each of the cylinders (not shown) of the engine. Also shown are a first fuel tank 16 for the main fuel such as alcohol and a second fuel tank 18 for the auxiliary fuel such as diesel fuel.

The construction of the rotary-distributor type fuel injection pump 10 is well known in the art, thus details thereof which are not pertinent to the present invention are omitted. In brief, the pump 10 has a feed pump 20 and a cam plate 22, which are driven by a drive shaft (not shown). The pump 10 further has a roller 24 and a plunger 26, the roller 24 engaging with the cam plate 22 to rotatably reciprocate the plunger 26. The pump 10 further has a cylinder 28 mounted in the body of the pump 10, the plunger 26 being slidably inserted in the cylinder 28 so as to define a pressure chamber 30 at the end of the plunger 26 within the cylinder 28. An intake groove 32 is formed on the outer surface of the plunger 26 at the end thereof. The first fuel can be forced from the pump chamber in the pump body through a fuel passage 34 and the intake groove 32 into the pressure chamber 30.

A central port 36 extends through the plunger 26, which is connected at the intermediate position thereof to a radial delivery port 38, which opens toward the inner surface of the cylinder 28. At the circumferential positions of the plunger 26, a plurality of delivery passages 40 are formed in the cylinder 28 and the body of the pump 10 (only one passage 40 is shown in FIG. 1). The number of delivery passages 40 corresponds to that of the cylinders of the engine. The first fuel is delivered cyclically from the delivery passages 40 one after another when the delivery port 38 of the plunger 26 is aligned with a particular delivery passage 40. One end of the central port 36 opens to the pressure chamber 30, and the other end thereof terminates at spill ports 42, which are selectively enclosed by a controllable spill ring 44 to control the completion of the fuel injection process. It will be readily understood that the spill ring 44 can be controlled by a known mechanism such as a governer and an adjusting lever. Further, a fuel cut solenoid valve 46 can be mounted to block the fuel passage 34, and a delivery valve 48 can be arranged in each of the fuel delivery passages 40.

The second fuel injection pump 12 comprises a body 50 having a generally T-shaped cavity. The top of the "T" constitutes a fuel through passage through the body 50 having a fuel inlet 52 and a fuel outlet 54. The second fuel can be supplied from the second fuel tank 18 to the fuel inlet 52 by means of a feed pump 56. The leg of the "T" constitutes a bore 60 which communicates with the through fuel passage. A delivery piston 58 is slidably inserted in the bore 60 so that the delivery piston 58 can reduce the volume in the through fuel passage to deliver the second fuel under a pressure when the piston 58 moves to the right in FIG. 1.

The body 50 of the second fuel injection pump 12 is threadably secured to the body of the first fuel injection pump 10 in such a manner that the bore 60 of the second fuel injection pump 12 opens to the pressure chamber 30 of the first fuel injection pump 10 formed by the end of the plunger 26. The delivery piston 58 thus can receive from behind the pressure in the pressure chamber 30 to reduce, as mentioned above, the volume in the fuel through passage. When the pressure in the pressure chamber 30 is released, the piston 58 is moved to the left by means of a compression spring 62 which forces the piston 58 toward the pressure chamber 30. The piston 58 has an annular flange for engaging with a shoulder of the bore 60 to limit the retracted position of the piston 58. The advanced position of the piston 58 is also limited by engagement of the front end thereof with the opposing inner wall of the fuel through-passage. Thus the stroke of the piston 58 is maintained constant, which ensures a constant delivery of the second fuel. Further, a check valve 64 is located adjacent to the fuel inlet 52 to allow a fuel inlet operation only, and a check valve 66 is located adjacent the fuel outlet 54 to allow a fuel outlet operation only.

It will be understood that the fuel injection nozzles 14 have an identical construction, although only one of the nozzles 14 is shown in detail. It will be also understood that the upper part of that nozzle 14 is omitted in the drawings for the purpose of clarity.

Each of the fuel injection nozzles 14 comprises a body 70 with a cavity therein, a fuel injection port 68 at the lower end of the body 70 for injecting the fuel from the cavity to the relevant cylinder of the engine, a valve seat 69 about the port 68, and a needle valve 72 inserted in the body 70. As shown in FIG. 1, the inner surface of the body 70 is cylindrically shaped and the valve seat portion 69 is conically shaped. The needle valve 72 is correspondingly cylindrically shaped, with the free end thereof conically shaped to engage with the valve seat 69 portion and open or close the port 68. The needle valve 72 has at its intermediate portion a tapered enlargement 72*a* surrounded by an annular reservoir 71. The clearance between the cylindrical inner surface of the body 70 and the cylindrical outer surface of the needle valve 70 is selected such that the clearance in the upper region above the annular reservoir 71 is small enough to allow a slidable guidance of the needle valve 72 within the body 70, and the clearance in the lower region below the annular reservoir 71 is also small but allows passage of the fuel from the reservoir 71 to the bottom of the body 70. The pressure of the fuel in the reservoir 71 acts on and thus lifts the tapered enlargement 72*a* of the needle valve 72. The needle valve 72 is also downwardly biased by a compression spring arranged in the omitted upper portion, as in most conventional fuel injection nozzles.

A first fuel inlet passage 74 is formed through the body 70 of the fuel injection nozzle 14. The first fuel inlet passage 74 extends through the annular reservoir 71 and the annular space defined by the clearance between the inner surface of the body 70 and the outer surface of the needle valve 72. The first fuel intake passage 74 of each of the fuel injection nozzles 14 is interconnected by a fuel pipe 76 to one of the fuel delivery passage 40, respectively.

A second fuel intake passage 78 is formed through and extends axially of the body 70, becomes a radial course crossing the interface between the body 70 and the needle valve 72, and then extends axially along the center axis of the needle valve 72. The central passage 78 is then opened to the outer surface of the needle valve 72 by a plurality of radial ports just above the valve seat 69. A check valve 80 is mounted on the fuel injection nozzle 14 to prevent any backflow of the fuel in the fuel injection nozzle toward the outside of the nozzle 14. The second fuel inlet passages 78 of all nozzles 14 are commonly connected by respective pipes 82 to the single outlet 54 of the second fuel injection pump 12.

The operation of the multi-fuel injection system is described below with reference to FIG. 2.

The first fuel is taken in and pressurised in the pressure chamber 30 of the first fuel injection pump 10 by the plunger 26 during each reciprocating movement thereof, and then delivered from the specific delivery passage 40 matching the relevant delivery port 38. It is assumed that this multi-fuel injection system is applied to a diesel engine having four cylinders, in which the fuel injection cycle is carried out in the order of cylinder Nos. I, III, IV and II, as shown in FIG. 2, in which the crank angle starts when a fuel injection is carried out for the No. I cylinder. The injection pressure $P_4$ of the first fuel is higher than the pressure P' at which the fuel injection nozzle 14 opens to inject the fuel into the engine cylinder.

During the fuel injection term of the No. I cylinder, the enhanced pressure in the pressure chamber 30 of the first fuel injection pump 10 causes the delivery piston 58 of the second fuel injection pump 12 to move to the right, to thereby deliver the second fuel from the common outlet 54 thereof to the second fuel intake passages 78 of all nozzles 14 under the pressure $P_1$, which is lower than the nozzle opening pressure P'. At the fuel injection nozzle 14 of the No. I cylinder which is now in the fuel injection timing, the pressure of the first fuel in the first fuel intake passage 74 is higher than the pressure of the second fuel in the second fuel intake passage 78, thus the second fuel cannot penetrate the first fuel intake passage 74 and the pressure of the first fuel tends to cause the second fuel to backflow in the second fuel intake passage 78. However, this backflow is prevented by the check valve 80, thus the second fuel in the second fuel intake passage 78 is maintained therein and only a part of the second fuel which had filled the tip of the first fuel intake passage 74 prior to the injection timing of the first fuel is injected into the cylinder of the engine together with the first fuel.

At the remaining three fuel injection nozzles 14, in which the first fuel is not injected, the second fuel is uniformly delivered to each of the second fuel intake passages 78 of the three nozzles 14 under the pressure $P_1$, which is lower than the nozzle opening pressure P' but higher than the remaining pressure in the first fuel intake passage 74 and the fuel pipe 76. This remaining pressure can be controlled by the delivery valve 48 in the delivery passage 40 of the first fuel injection pump 10. The second fuel in the second fuel intake passage 78 can penetrate the first fuel intake passage 74 while replacing the first fuel therein. The fuel injection does not occur at these remaining nozzles 14 since the pressure $P_1$ is lower than the nozzle opening pressure P', with the result that the metered amount of the second fuel is filled at the tip of the first fuel intake passage 74.

The amount of the second fuel filled in the first fuel intake passage 74 in each of the nozzles 14 increases along the fuel injection cycle. For example, at the fuel injection nozzle 14 of the No. II cylinder, the second fuel is filled under the pressure $P_1$ during the fuel injection term of the No. I cylinder, after the completion of fuel injection of that No. II cylinder. When the fuel injection of the No. I cylinder terminates, the pressure of the pressure chamber 30 of the first fuel injection pump 10 decreases, thus the delivery piston 58 of the second fuel injection pump 12 retracts to refill the second fuel in the internal chamber of the second fuel injection pump 12. At this instant, the pressure in the fuel pipe 82 may be lower than the pressure in the second fuel intake passages 78 of the nozzles 14, but the check valves 80 prevent any backflow of the second fuel. Then, at 180 degrees of the crank angle where the fuel injection of the No. III cylinder is carried out, the second fuel is equivalently filled in the second fuel intake passages 78 of the remaining three fuel injection nozzles under the pressure $P_1$. At the fuel injection nozzle 14 of the No. II cylinder, the second fuel is filled under the pressure $P_2$, which corresponds to two fuel injections under the pressure $P_1$. Subsequently, at 360 degrees of the crank angle where the fuel injection of the No. IV cylinder is carried out, the second fuel is further filled under the pressure $P_3$, which corresponds to three fuel injections under the pressure $P_1$.

When the real fuel injection timing of the No. II cylinder at 540 degrees of the crank angle occurs, the second fuel, which had filled the end of the first fuel intake passage just above the valve seat 69, is first injected into the cylinder of the engine and readily self-ignites during the compression stroke of the engine. The first fuel then follows in a stratified manner which is steadily ignited by the burning second fuel.

It should be noted that the above-described multi-fuel injection system according to the present invention, comprising a rotary-distributor type fuel injection pump and a single fuel injection pump of a very simple construction, makes it possible to inject two different fuels in a stratified manner by the fuel injection nozzles of all cylinders in the engine. Since the second fuel injection pump can deliver the second fuel from the single and common outlet thereof to all of the fuel injection nozzles, the variation of the filled second fuel between the cylinders due to the manufacturing variations of the elements becomes very small. Further, the filled second fuel is arithmetically averaged, whereby the injected second fuel is uniformly distributed into a plurality of nozzles and this distribution is repeated a plurality of times which correspond to the number of the cylinders of the engine minus one. This averaged second fuel makes it possible to reliably ignite the first fuel even though the amount of the second fuel is relatively small. Further, the second fuel injection pump is directly mounted on the first fuel injection pump, which enables the whole arrangement to be very compact.

Figure 3:
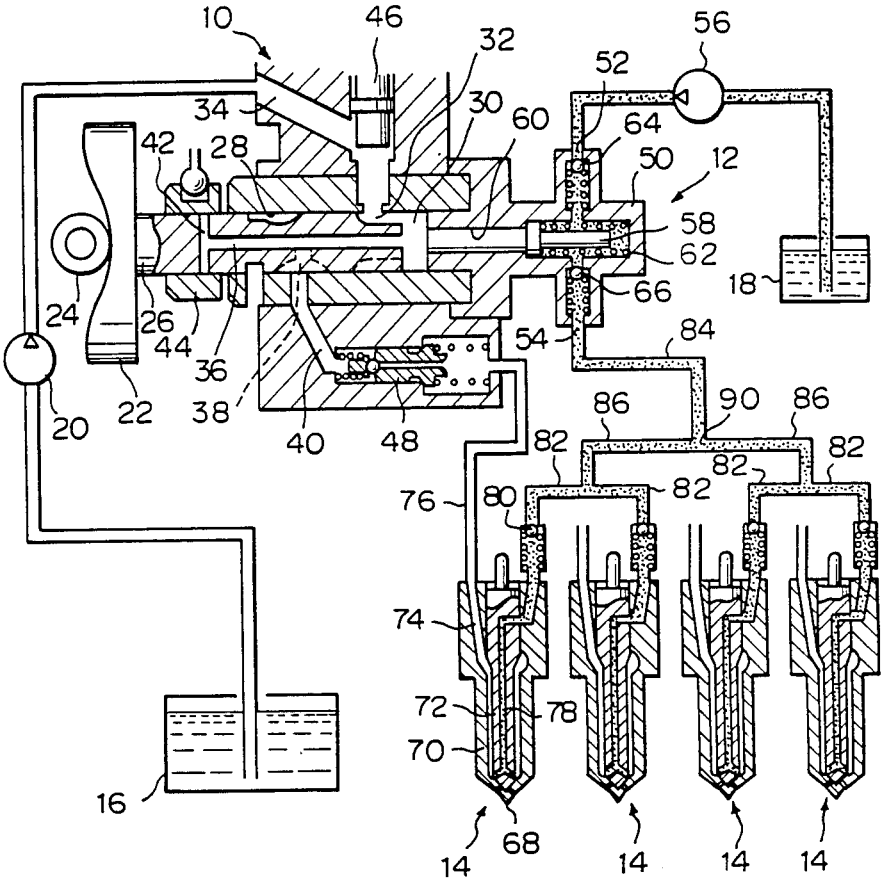
FIGS. 3 and 4 are views similar to FIG. 1 but emphasizing the identical pipe connections between the second fuel injection pump and the fuel injection nozzles, respectively.
Figure 4:
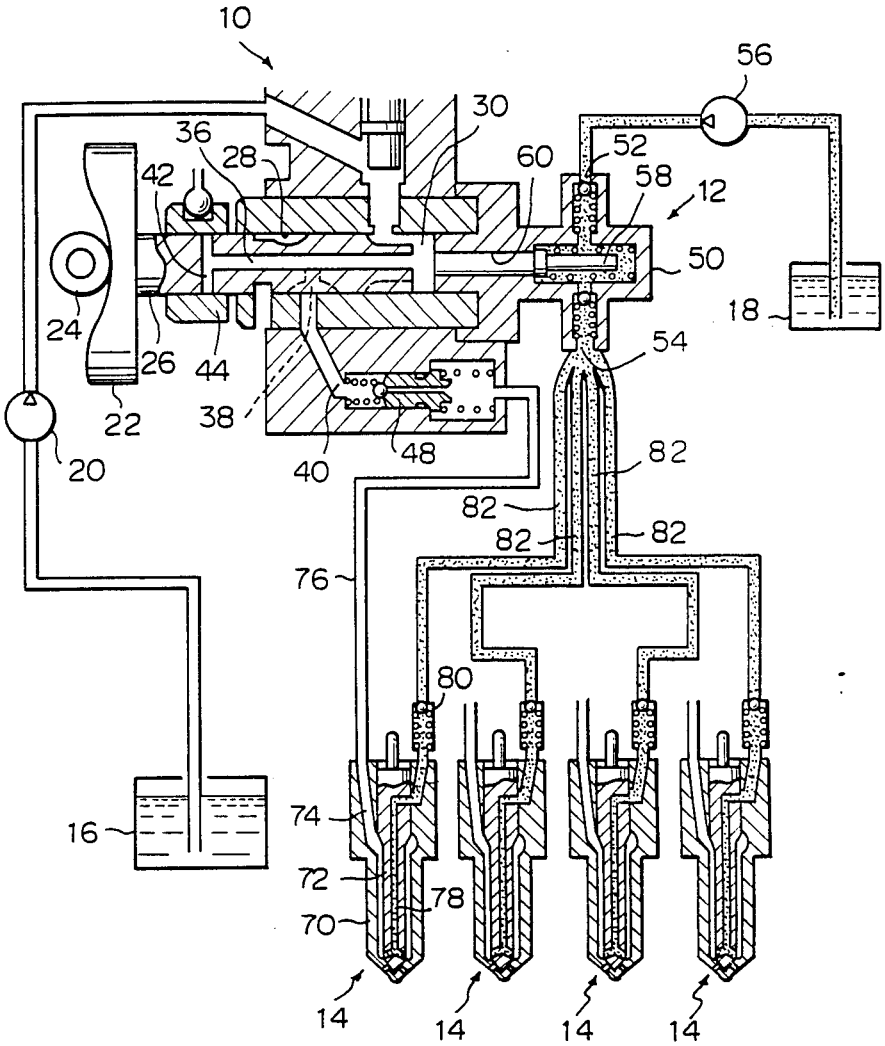

It will be appreciated that the fuel pipes 82 connecting the single and common outlet 54 of the second fuel injection pump 12 to each of the second fuel intake passages 78 of the nozzles 14 preferably have dimensional characters such that they have a substantially identical flow resistance in order to uniformly distribute the second fuel into a plurality of fuel injection nozzles 14. This feature is exemplified in FIGS. 3 to 7, respectively. In FIG. 3, a common fuel pipe 84 extend from the outlet 54 of the second fuel injection pump 12. At the end of the common pipe 84, there are two branched fuel pipes 86 having an identical diameter and length. The fuel pipes 82 also have an identical diameter and length and are connected to each end of the branched fuel pipes 86. It will be clear that the length of the pipes from and outlet end 90 of the common pipe 84 to each of the nozzles 14 is equal. In FIG. 4, all fuel pipes 82 of a similar dimension are directly connected to the outlet 54 of the second fuel injection pump 12, instead of the branched pipes in FIG. 3. FIGS. 5 to 8 show pipe connections similar to those in FIGS. 3 and 4, respectively.

Figure 5:
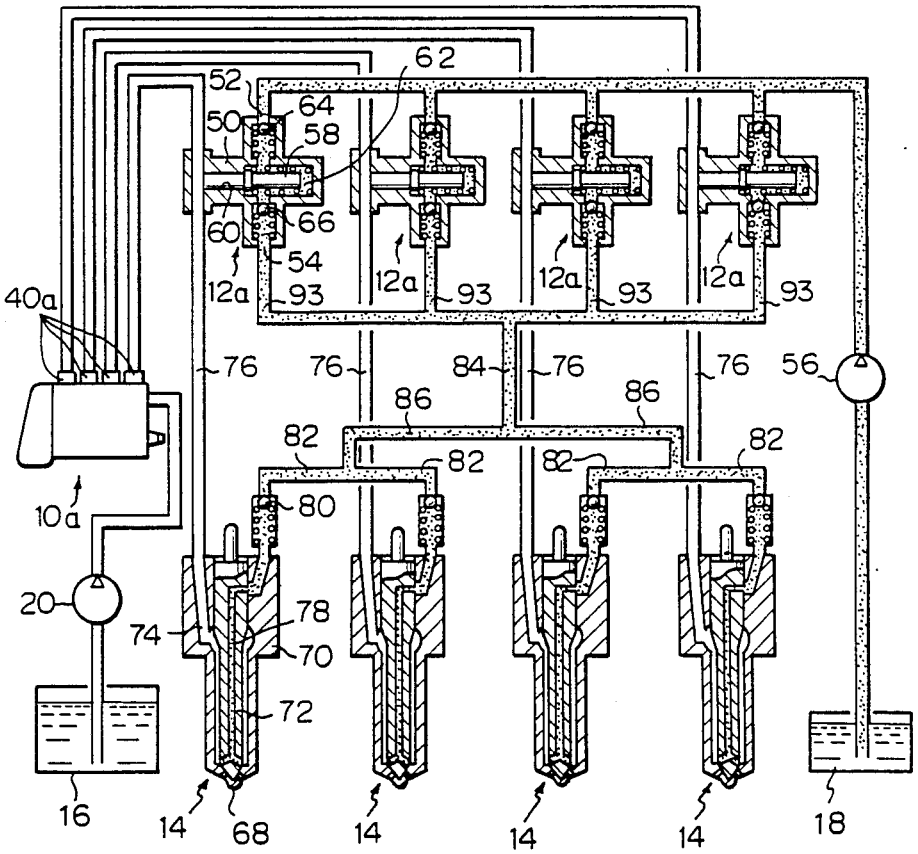
FIGS. 5 to 7 are views illustrating a second embodiment of the present invention and also emphasizing the identical pipe connections between the second fuel injection pump means and the fuel injection nozzles, respectively.
Figure 6:
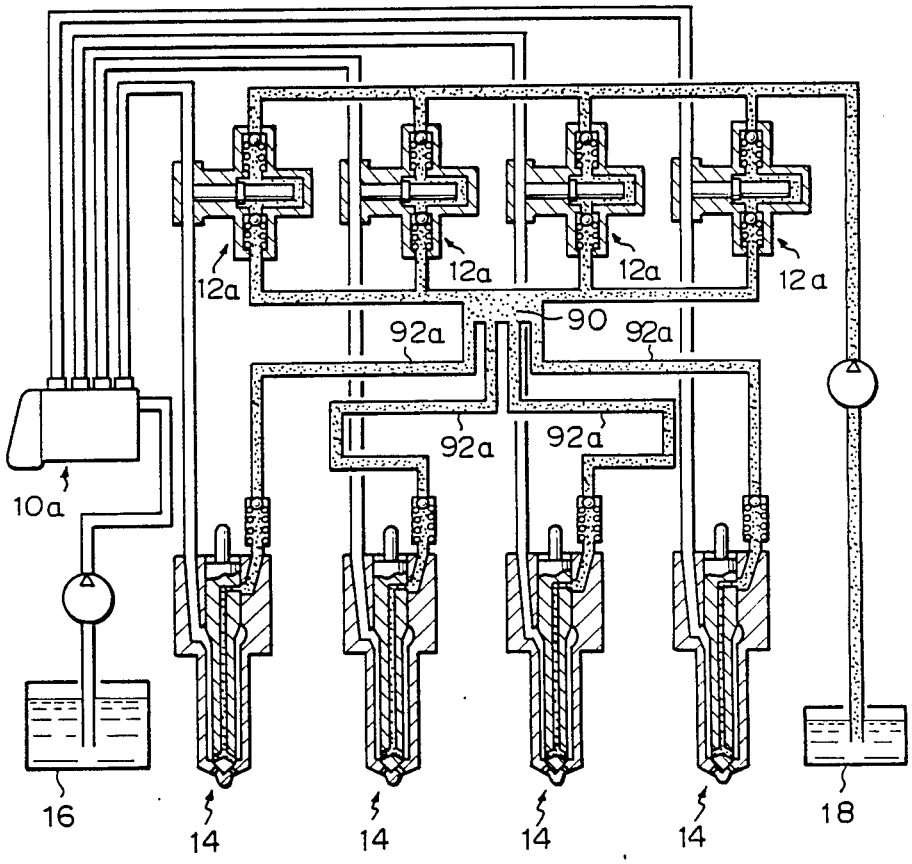

FIG. 5 shows a second embodiment of the present invention, in which an in-line type fuel injection pump 10*a* is used as a first fuel injection pump. The in-line type fuel injection pump 10*a* is conventionally constructed and has a plurality of fuel outlets 40*a* to deliver the fuel under a pressure higher than the nozzle opening pressure to each of the cylinders of the engine. The fuel injection nozzles 14 have a similar construction to that of the previous embodiment. A set of fuel pipes 76 interconnect the fuel outlets 40*a* of the first fuel injection pump 10*a* and the first fuel intake passages 74 one by one, respectively.

The second fuel injection pump means comprises a plurality of pumps 12*a* and a common fuel pipe 84 as a single outlet. Each pump 12 has a construction similar to the second fuel injection pump 12 in FIG. 1 and thus comprises a body 50 having a through fuel passage with a fuel inlet 52 and a fuel outlet 54, a bore 60 formed in the body 50 so as to communicate with the through fuel passage, and a delivery piston 58 slidably inserted in the bore 60. Each of the bores 60 is in fluid communication with one of the fuel pipes 76, one by one, so that the delivery piston 58 receives the pressure of the first fuel in the respective fuel pipes 76. All outlets 54 are merged to the common fuel pipe 84 through fuel pipes 93.

It will be appreciated that each fuel pump 12*a* delivers one shot of the second fuel during every operational cycle of the engine, thus the four fuel pumps 12 deliver the second fuel four times, similar to the operation of the second single pump 12 in FIG. 1. The second fuel thus delivered is uniformly distributed from the common fuel pipe 84 to the second fuel intake passages 78 of the nozzles 14.

Figure 7:
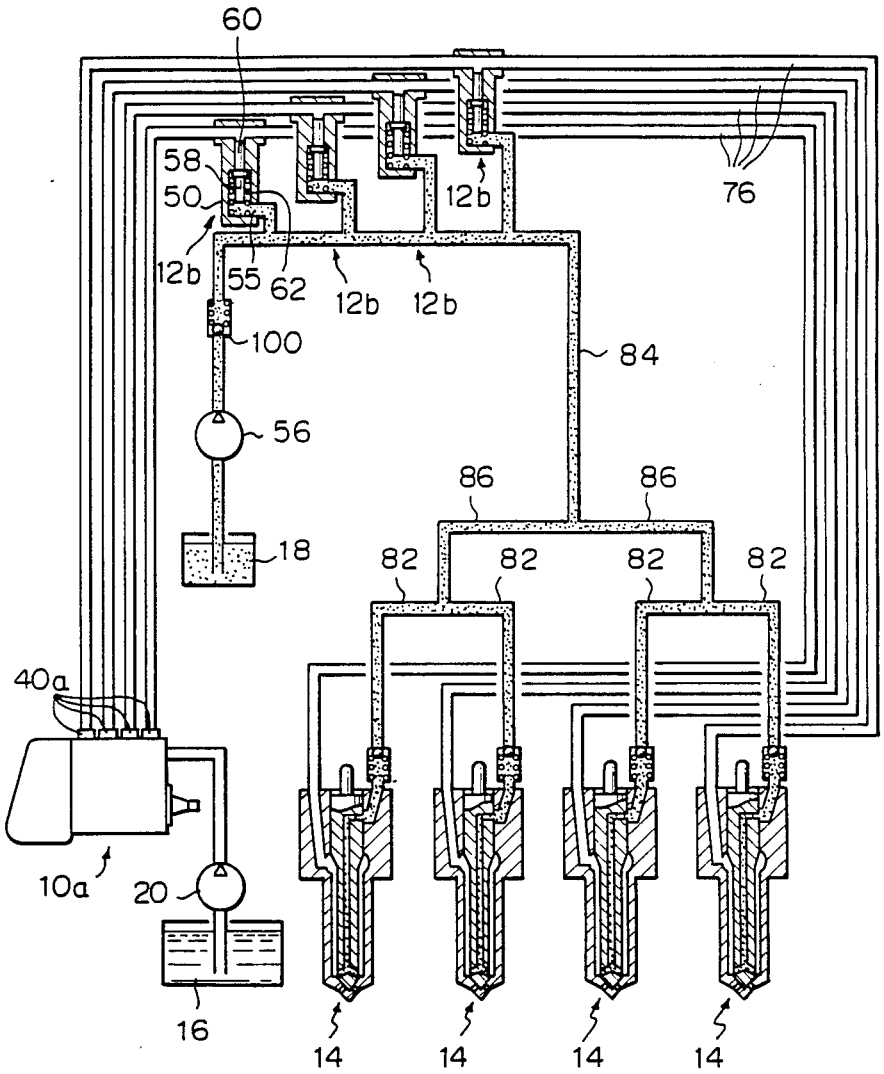

FIG. 7 shows a similar arrangement to that of FIG. 5, but includes a plurality of fuel pumps 12*b* instead of the fuel pumps 12*a*. Each fuel pump 12*b* comprises a body 50 having a single port 55 which meets a bore 60 having a piston 58 inserted therein. The port 55 is used as a fuel inlet when the piston 58 retracts, and as a fuel outlet when the piston 58 advances. A check valve 100 is provided in the fuel pipe upstream of the fuel pumps to prevent a backflow of the second fuel.

FIGS. 8 to 14 show further embodiments of the present invention wherein the second fuel injection pump means is mechanically linked to the first fuel injection pump means for synchronous operation therewith.

Figure 8:
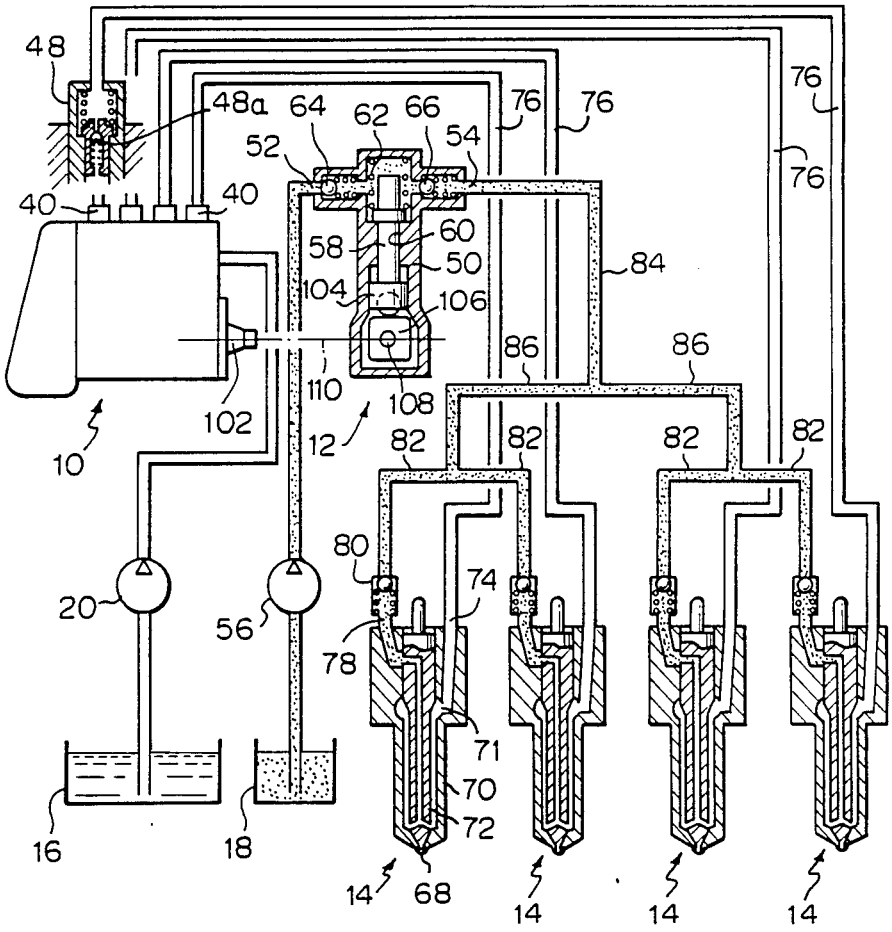
FIG. 8 is a view illustrating a third embodiment of the present invention.

In FIG. 8, the multi-fuel injection system according to the present invention comprises a first fuel injection pump 10, a second fuel injection pump 12, and a plurality of fuel injection nozzles 14. The first fuel injection pump 10 can be a conventional rotary-distributor type or an in-line type and has a rotatable driving shaft 102 for driving a pumping element such as a plunger 26 (FIG. 1). The delivery valve 48 is a constant pressure type having a small check valve 48*a* located inside of the valve member of the delivery valve to maintain the remaining pressure constant in the fuel pipes 76 and the first fuel intake passage 74 in each of the nozzles 14, which have a similar construction to those of the previous embodiment.

The second fuel injection pump 12 comprises a body 50 having a through fuel passage with a fuel inlet 52 and a fuel outlet 54, as in the previous embodiment, with check valves 64 and 66 located therein. The second fuel injection pump 12 further comprises a delivery piston 58 inserted in a bore 60, a tappet 104, and a cam 106. The cam 106 is secured to a drive shaft 108 which is interconnected to the drive shaft 102 of the first fuel injection pump 10 through an intermediate shaft 110. The cam 106 has four projecting lobes on the circumference thereof to operate the piston 58 through the tappet 104.

Figure 2:
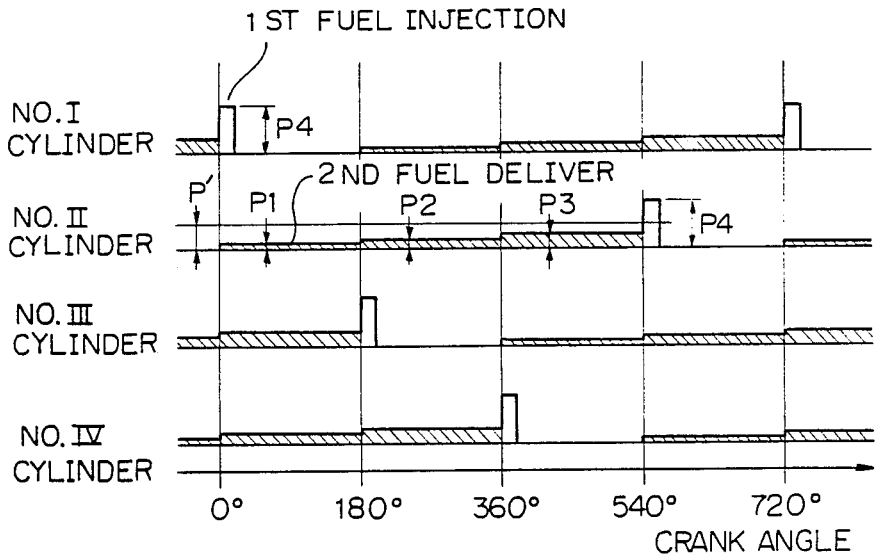
FIG. 2 is a view illustrating a fuel injection process.
Figure 9:
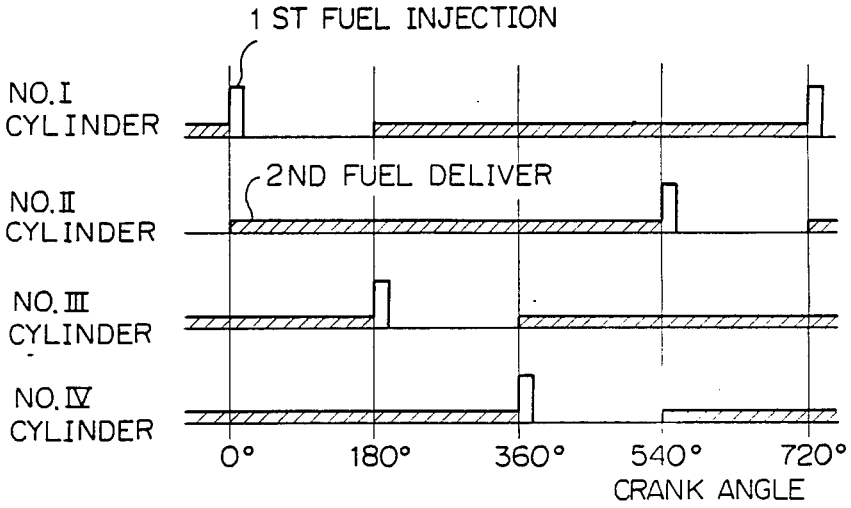
FIG. 9 is a view illustrating a fuel injection process attained by the system of FIG. 8.

FIG. 9 shows a diagram similar to FIG. 2, but the pressure of the filled second fuel is maintained constant in the first fuel intake passage 74 by the constant pressure delivery valve 48 even though the second fuel is delivered three times in each of the nozzles 14.

Figure 10:
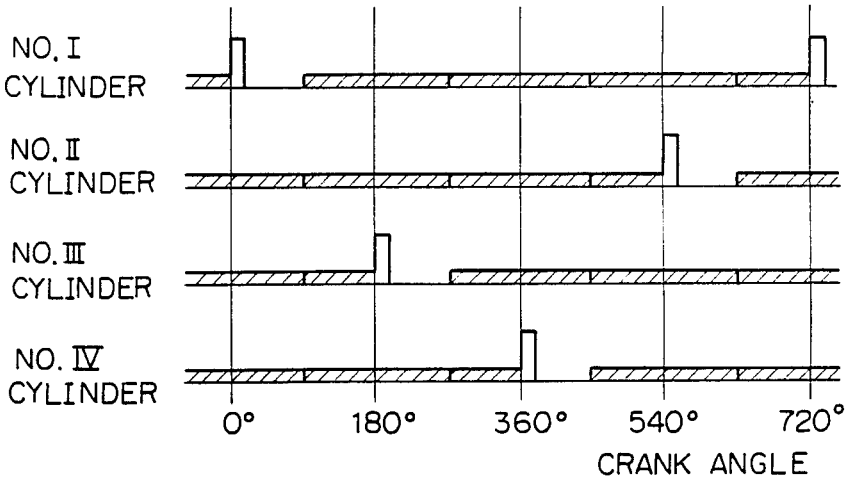
FIG. 10 is a view illustrating an alternate fuel injection process attained by the system of FIG. 8.

FIG. 10 shows that the delivery of the second fuel can be effected synchronously with the fuel injection timing of the first fuel but is shifted therefrom by a certain crank angle. With this arrangement, the second fuel can be filled in each of the nozzles 14 four times for every operating cycle of the engine.

Figure 11:
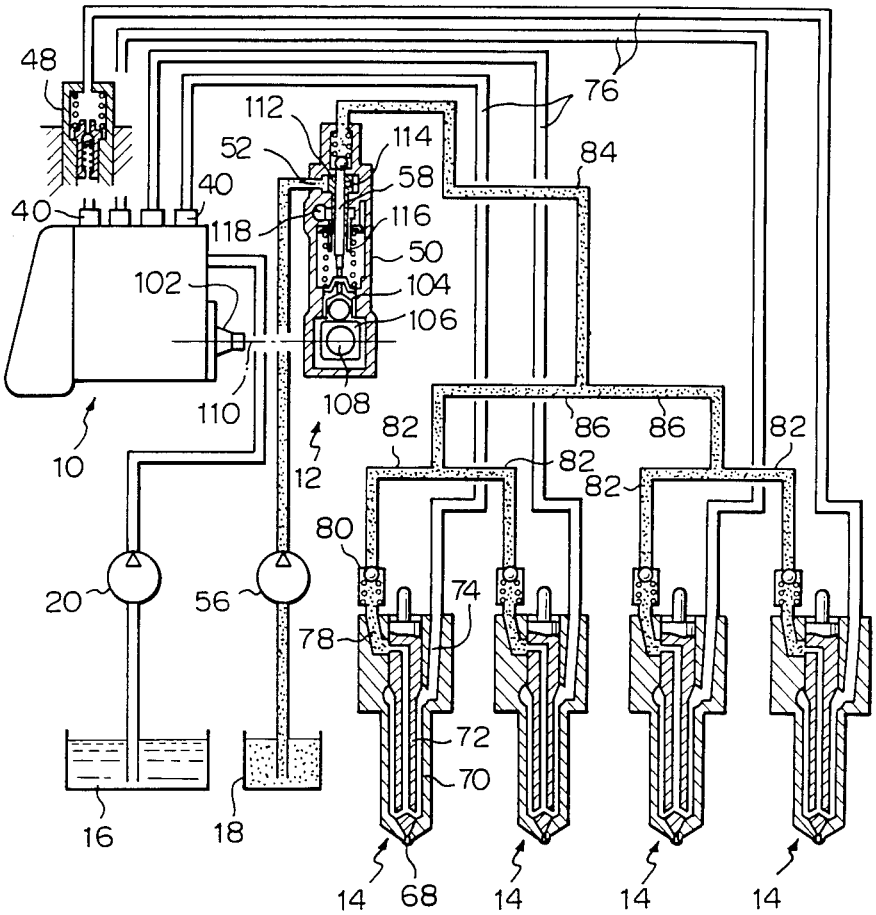
FIG. 11 is a view illustrating a fourth embodiment of the present invention.

In FIG. 11, the second fuel injection pump 12 comprises a housing 50, a cylinder 112 mounted in the housing 50 and having a feed hole 114 which communicates with the fuel inlet 52, a plunger 58 inserted in the cylinder 112, a control sleeve 116 having a pinion mounted thereon, and a rack 118 mating with a pinion. It will be understood to a person having an ordinary skill in the art that, although not shown in the drawing, the plunger 58 has a recess which extends axially from the top of the plunger 58, and a tapered groove on the periphery of the plunger 58 to cooperate with the feed hole 114 for controlling the amount of the fuel to be injected. For this purpose, the angular position of the plunger 58 can be controlled by the control rack 118 through the pinion and the control sleeve 116.

Figure 12:
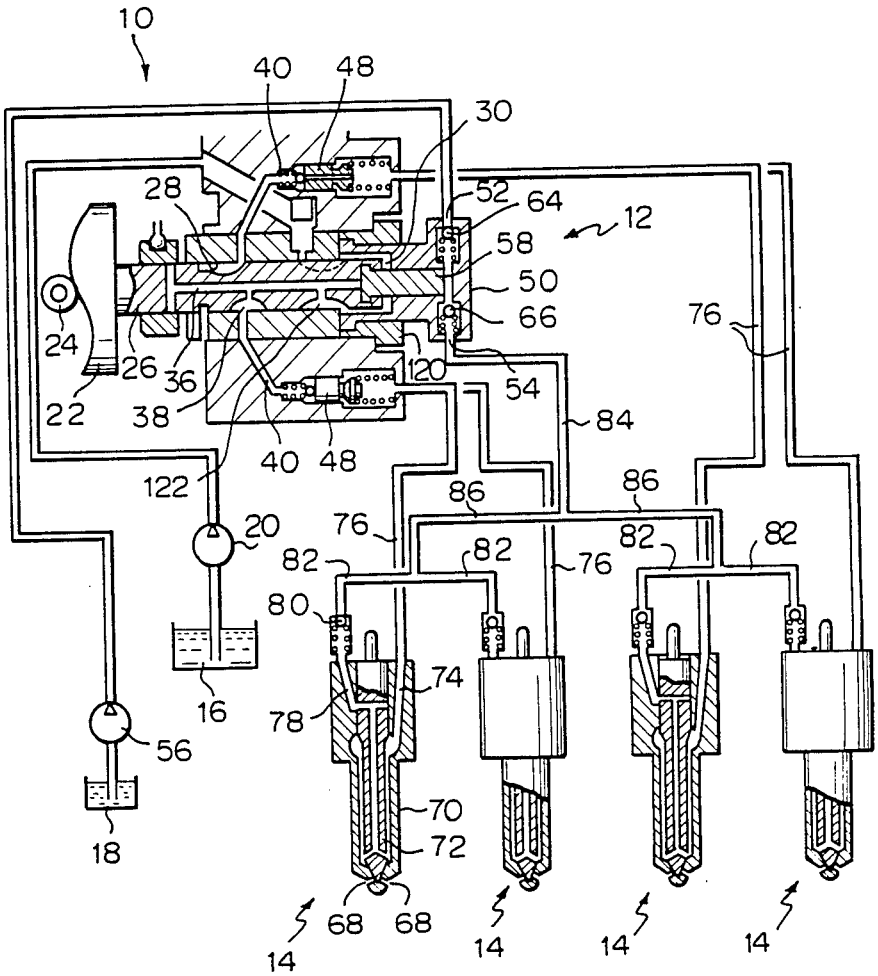
FIGS. 12 to 14 are views, respectively, illustrating further embodiments of the present invention.

In FIG. 12, the second fuel injection pump 15 is attached to the first fuel injection pump 10, similar to FIG. 1, by a threaded fastening member 120. The plunger 26 of the first fuel injection pump 10 has a length greater than that in FIG. 1. The top of the extended plunger 26 has a recessed wall, into which the top of the delivery piston 58 of the second fuel injection pump 12 is inserted and is frictionally secured thereto.

Thus the second fuel injection pump 12 can operate synchronously with the first fuel injection pump. Since the piston 58 of the second fuel injection pump 12 extends through the pressure chamber 30 of the first fuel injection pump 10, the pressure chamber 30 is further extended circumferentially of the plunger 26, and then is communicated with the central port 36 through a further radial port 122.

Figure 13:
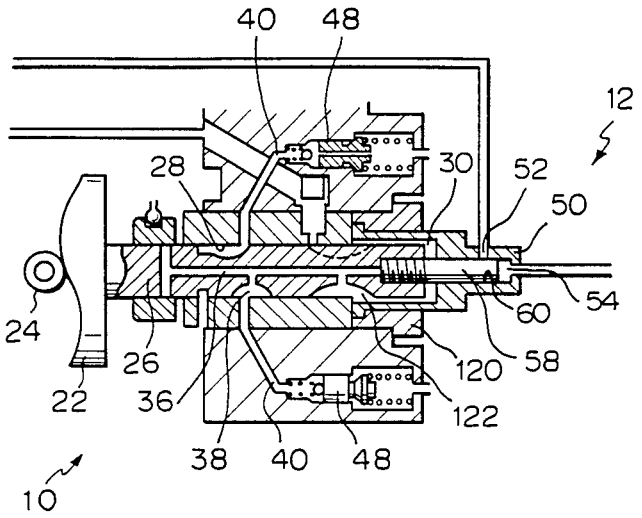
Figure 14:
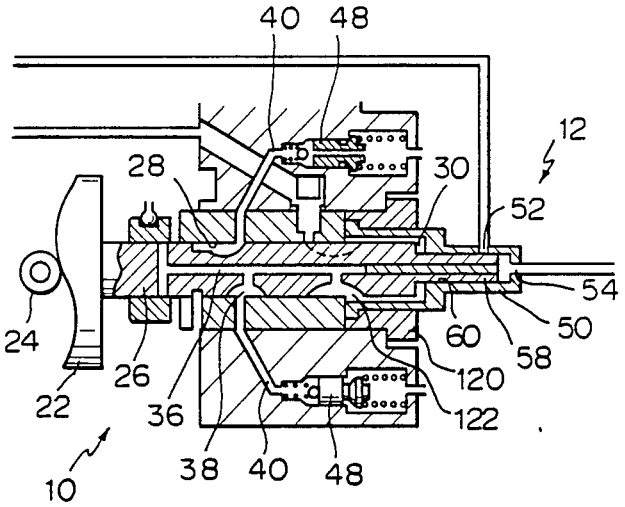

In FIG. 13, the piston 58 of the second fuel injection pump 12 is threadably secured to the plunger 26 of the first fuel injection pump 10. The body 50 has a bore 60 for insertion of the piston 58. The fuel inlet 52 opens at the lateral wall of the bore 60, and the fuel outlet 54 opens at the end wall of the bore 60. This is the simplest form of the second fuel injection pump 12. In FIG. 14, the plunger 26 is further extended from its cylinder 28 to become integral with a piston 58 of the second fuel injection pump 12.

FIGS. 15 to 21 show details of the fuel injection nozzles 14 having various features.

Figure 15:
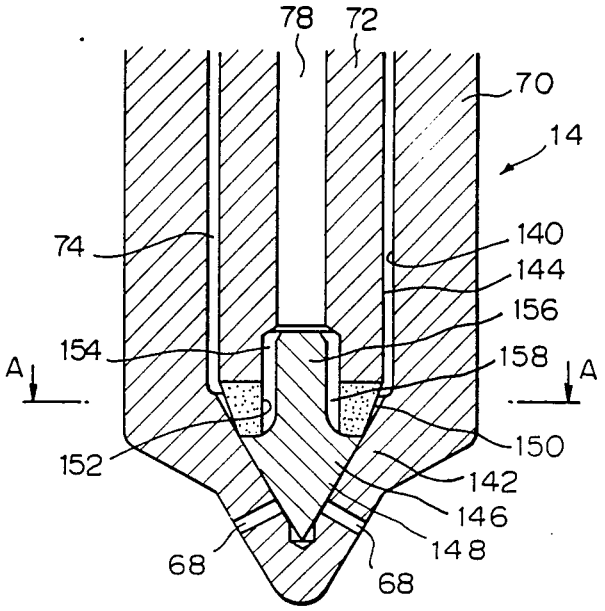
FIG. 15 is a longitudinal section of the fuel injection nozzle constructed according to the present invention.
Figure 16:
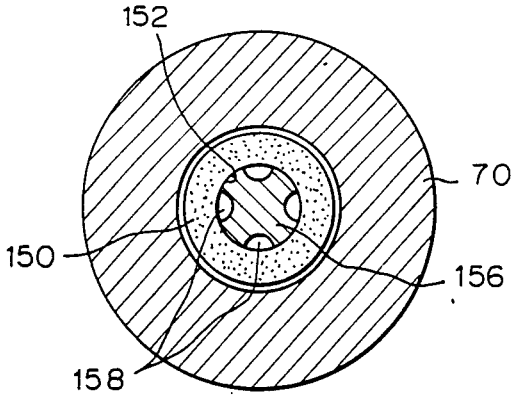
FIG. 16 is a cross section taken along the line A—A in FIG. 15.

Referring to FIGS. 15 and 16, as previously described, the body 70 of the nozzle 14 comprises a cylindrical inner surface portion 140 and a conical valve seat portion 142. The valve member 72 comprises a cylindrical outer surface portion 144 slidably fitted in the cylindrical inner surface portion 140 and a conical end portion 146 engaging with the conical valve seat portion 142. The conical end portion 146 can be separated into two parts, namely, a first conical portion 148 on the free end side thereof to closely engage with the valve seat portion 142, and a second conical portion 150 adjacent to the cylindrical outer surface portion 144. The taper of the second portion 150 is slightly less than that of the conical valve seat portion 142, to allow play therebetween for better seating of the first portion 148 with the valve seat portion 142.

This valve member 72 is formed by three separate elements corresponding to the above-described portions 144, 148 and 150. The second portion 150 is formed by a truncated conical ring of porous material, such as sintered metal, having a center hole 152. The cylindrical outer surface portion 144 has a cylindrical recess 154 communicatable with the straight passage of the second fuel inlet passage 78. The first portion 148 has a stem 156 at the back of the conical surface. This stem 156 is fitted through the porous conical ring 150 in the recess 154 of the cylindrical portion to effect the assembly. The stem 156 has a plurality of longitudinal grooves on the periphery thereof to allow communication between the straight passage of the second fuel inlet passage 78 and the porous conical ring 150. The second fuel, which reaches the inner surface of the porous conical ring, passes through the porous ring 150 to the outside thereof. In this course from inside to the outside of the porous ring, the second fuel not only passes in the radial direction but also passes in the circumferential direction of the porous ring 150, thereby the second fuel can be forced out uniformly over the whole circumference of the porous conical ring 150. This assures that the second fuel can be filled at the extreme end of the fuel injection nozzle 14, by replacing the first fuel in the narrow end space.

Figure 17:
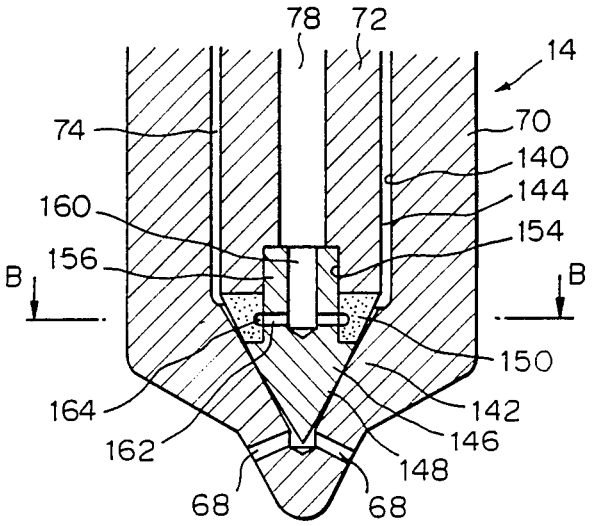
FIG. 17 is a longitudinal section of the variant fuel injection nozzle.
Figure 18:
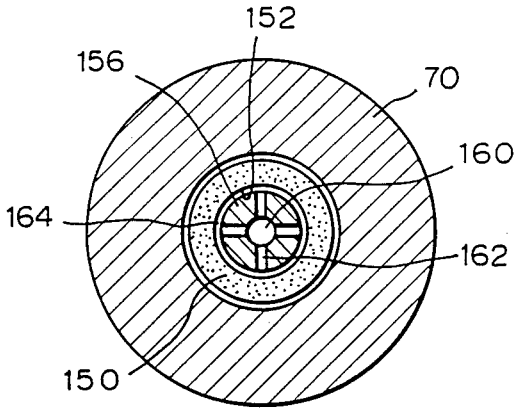
FIG. 18 is a cross section taken along the line B—B in FIG. 17.

FIGS. 17 and 18 show a modified embodiment similar to that of FIGS. 15 and 16 but differing in that the stem 156 of the first portion 148 has a center hole 160, a plurality of radial holes 162, and an annular groove 164 to enable communication between the straight passage of the second fuel inlet passage 78 and the inner surface of the porous ring 150.

Figure 19:
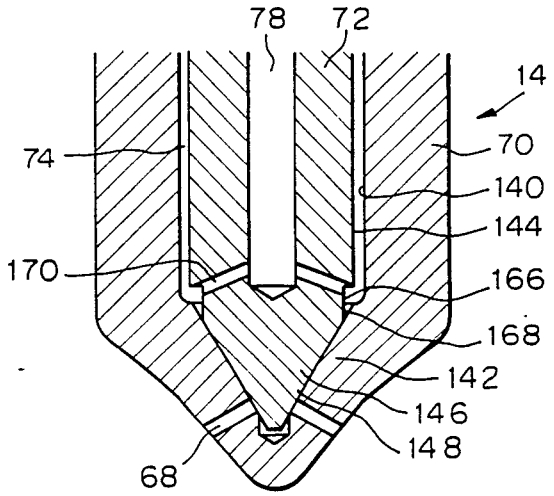
FIG. 19 is a longitudinal section of the modified fuel injection nozzle according to the present invention.
Figure 20:
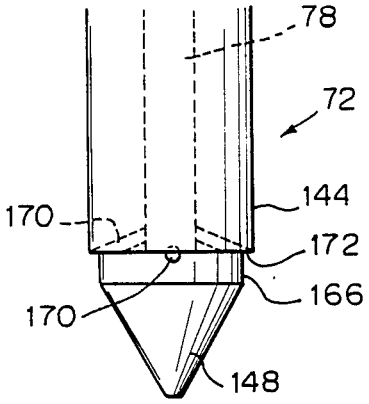
FIG. 20 is a front elevation of the valve member in the nozzle of FIG. 19.
Figure 21:
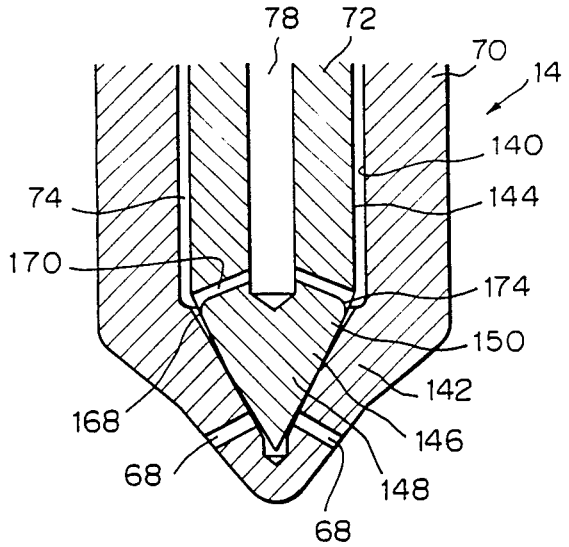
FIG. 21 is a longitudinal section of the further modified fuel injection nozzle according to the present invention.

FIG. 19 and 21 show further modification of the fuel injection nozzle 14 according to the present invention. The valve member 72 has a further cylindrical portion 166 between the cylindrical portion 144 and the valve end portion 146, in place of the second conical portion 150 in FIGS. 15 and 16, the diameter of this further cylindrical portion being slightly smaller than that of the cylindrical portion 144 so that a small annular space 168 is defined between the further cylindrical portion 166 and the valve seat portion 142. A plurality of fuel outlet passages 170 extend radially from the straight passage of the second fuel intake passage 78, and are open at the further cylindrical portion 166. The fuel outlet passages 170 preferably taper so as to communicate directly with the space 168. The fuel outlet passages 170 are preferably open at the shoulder between the cylindrical portions 144 and 166. Upward flow of the second fuel delivered into the first fuel inlet passage 74 is obstructed by the shoulder 172, so that the second fuel can be filled in the space 168 at the extreme end position of the nozzle 14.

FIG. 21 shows a further modification of the fuel injection nozzle 14, wherein the outlet passages 170 extending radially from the straight passage of the second fuel inlet passage 78 are open at the second portion 150 of the conical end portion 146 of the valve member 70 so as to fill the narrow space 168. The wall defining the outlet passage 170, namely, the mouth 174 of the outlet passage 170, is rounded toward the free end of the valve member 70. This assists the second fuel to enter the narrow space 168.

What is claimed is:

1. A multi-fuel injection system for an internal combustion engine having a plurality of cylinders, said system comprising:

a first fuel injection pump means having a plurality of fuel outlets for delivering a first fuel in a predetermined cycle under a pressure higher than a predetermined value;

a second fuel injection pump means having a single fuel outlet and adapted to be driven synchronously with the first fuel injection pump means for delivering a second fuel under a pressure lower than said predetermined value;

a plurality of fuel injection nozzles arranged one by one for each cylinder of the engine, each of said fuel injection nozzles comprising a body having a cavity therein, at least one fuel injection port for injecting the fuel from said cavity to the relevant cylinder, a valve seat about said fuel injection port, a valve member inserted in said body so as to engage with said valve seat to open or close said fuel injection port, a first and a second fuel inlet passages formed through said body for introducing said first and said second fuels into said cavity, respectively, and means for causing said valve member to open said fuel injection port when the pressure of the introduced fuel is higher than said predetermined value and to close said port when the pressure is lower than said predetermined value;

a first set of fuel pipes for interconnecting the outlets of the first fuel injection pump means and the first inlet passages of the fuel injection nozzles one by one, respectively;

a second set of fuel pipes each having one end thereof commonly connected to said single outlet of said second fuel injection pump means and the other end connected to the second fuel inlet passages of the fuel injection nozzles one by one; and means for preventing a backflow of the second fuel from each of said second inlet passages to said single outlet of said second fuel injection pump means.

2. A system according to claim 1, wherein said second set of fuel pipes have dimensional characters such that a substantially identical flow resistance is provided therein.

3. A system according to claim 1, wherein said first fuel injection pumps means is a rotary-distributor type fuel injection pump comprising a cylinder, a plunger rotatably and reciprocatingly inserted in said cylinder so as to define a pressure chamber at one side of the plunger within said cylinder, and wherein said second fuel injection pump means is arranged in such a manner that it can be driven by the pressure in said pressure chamber in said first fuel injection pump means.

4. A system according to claim 3, wherein said second fuel injection pump means comprises a body having a fuel passage and a bore formed therein, and a piston inserted in said bore to deliver the second fuel in said fuel passage, said body of said second fuel injection pump means being attached to said cylinder of said first fuel injection pump means with said bore in fluid communication with said pressure chamber, thereby the pressure in the pressure chamber can operate said piston to reduce the volume in the fuel passage to pressurize the second fuel introduced therein.

5. A system according to claim 4, wherein a check valve is provided at a fuel inlet of said fuel passage to allow only an inflow, and a further check valve is provided at a fuel outlet of said fuel passage to allow only an outflow.

6. A system according to claim 1, wherein said first fuel injection pump means is an in-line type fuel injection pump having a plurality of pump elements in registration with the fuel outlets, and wherein said second fuel injection pump means comprises a plurality of pump and a common delivery pipe, each of said plurality of pumps comprising a body having a fuel passage and a bore formed therein, and a piston inserted in said bore to deliver the second fuel in said fuel passage, each of said bores of said plurality of pumps being in fluid communication with one of said first set of fuel pipes one by one with said fuel passage commonly merging to said common delivery pipe which commonly leads said second set of fuel pipes, thereby the pressure in the first set of fuel pipes can operate cyclically the respective pistons of said plurality of pumps.

7. A system according to claim 1, wherein said second fuel injecting pump means is mechanically linked to said first fuel injection pump means for synchronous operation therewith.

8. A system according to claim 7, wherein said first fuel injection pump means has a rotatable drive shaft, and said second fuel injection pump means has a rotatable cam and a pumping element adapted to follow said cam, said cam being mechanically linked to said drive shaft of said first fuel injection pump means.

9. A system according to claim 8, wherein said second fuel injection pump means comprises a body having a fuel passage and a bore formed therein, and a piston inserted in said bore to deliver the second fuel in said fuel passage, said piston following said cam.

10. A system according to claim 8, wherein said second fuel injection pump comprises a cylinder having a feed hole, a plunger inserted in said cylinder with a top thereof, and a tapered groove on the periphery thereof cooperating with said feed hole for controlling the fuel injection, and a means for controlling the angular position of said plunger, said plunger following said cam.

11. A system according to claim 7, wherein said first fuel injection pump means is a rotary-distributor type fuel injection pump comprising a cylinder, and a plunger rotatably and reciprocatingly inserted in said cylinder, and said second fuel injection pump means has a pumping element which is coupled to said plunger of said first fuel injection pump means.

12. A system according to claim 11, wherein said pumping element of said second fuel injection pump means is frictionally secured to said plunger of said first fuel injection pump means.

13. A system according to claim 11, wherein said pumping element of said second fuel injection pump means is threadably secured to said plunger of said first fuel injection pump means.

14. A system according to claim 11, wherein said pumping element of said second fuel injection pump means is integrally extended from said plunger of said first fuel injection pump means.

15. A system according to claim 1, wherein said cavity of said fuel injection nozzle comprises a cylindrical inner surface portion and a conical valve seat portion, and said valve member comprises a cylindrical outer surface portion slidably fitted in said cylindrical inner surface portion and a conical end portion engaging with said conical valve seat portion, and wherein said first fuel inlet passage is defined by an annular clearance between said cylindrical inner and outer surface portions, and a second fuel inlet passage is defined within said valve member and comprises a straight passage generally axially extending along the center axis of the valve member and at least one outlet passage radially extending from said straight passage to the outer surface of said valve member.

16. A system according to claim 15, wherein said conical end portion of said valve member comprising a first conical portion on the free end side thereof to closely engage with said conical valve seat portion, and a second conical portion adjacent to said outer surface portion with the taper to allow play between said second conical portion and said conical valve seat portion.

17. A system according to claim 16, wherein said valve member is formed by a plurality of separate elements assembled together, said second conical portion being formed by a truncated conical ring of porous material which allows the passage of the second fuel from said straight passage to an outer peripheral portion thereof.

18. A system according to claim 17, wherein said outer peripheral portion is formed by a hollow element having a recess communicatable with said straight passage, and said first conical portion is formed by a separate element having a stem at the back of the conical surface, said stem being fitted through the porous conical ring in the recess of said cylindrical outer portion to effect the assembly and having a groove means to allow communication between said straight passage and said porous ring.

19. A system according to claim 17, wherein said groove means to allow communication between the straight passage and the porous conical ring comprises a plurality of grooves provided on the periphery of said stem.

20. A system according to claim 17, wherein said groove means to allow communication between the straight passage and the porous conical ring comprises a groove extending centrally in the stem and a plurality of radially extending grooves.

21. A system according to claim 15, wherein a further cylindrical portion is provided on the valve member between said cylindrical outer peripheral portion and the conical end portion, the diameter of said further cylindrical portion being slightly smaller than that of the cylindrical outer peripheral portion, said at least one outlet passage of said second fuel inlet passage opening at said further cylindrical portion.

22. A system according to claim 16, wherein said at least one outlet passage of said second fuel inlet passage opens at said second conical portion, the wall defining the outlet passage being rounded toward the free end of the valve member.

* * * * *